United States Patent [19]

Horton

[11] Patent Number: 4,648,750

[45] Date of Patent: Mar. 10, 1987

[54] JACKET TOWER STRUCTURE AND METHOD OF INSTALLATION

[76] Inventor: Edward E. Horton, 85 Vanderlip Dr., Portugese Bend, Calif. 90274

[21] Appl. No.: 715,931

[22] Filed: Mar. 25, 1985

[51] Int. Cl.[4] ..... E02D 21/00

[52] U.S. Cl. ..... 405/208; 405/205; 405/204; 405/203

[58] Field of Search ..... 405/203, 204, 205, 207, 405/208, 209

[56] References Cited

U.S. PATENT DOCUMENTS

| | | | |
|---|---|---|---|
| Re. 28,614 | 11/1975 | Crout et al. | 405/209 |
| Re. 29,413 | 9/1977 | Hekkanen et al. | 405/204 |
| 2,586,966 | 2/1952 | Kuss et al. | 405/203 X |
| 2,857,744 | 10/1958 | Swiger et al. | 405/208 |
| 3,859,806 | 1/1975 | Guy et al. | 405/204 |
| 4,101,230 | 7/1978 | Moe | 405/203 X |
| 4,448,570 | 5/1984 | Berthin | 405/207 X |

*Primary Examiner*—Alan Cohan
*Assistant Examiner*—John A. Rivell
*Attorney, Agent, or Firm*—Poms, Smith, Lande & Rose

[57] ABSTRACT

A jacket tower structure for use in deep water which includes a plurality of tapering jacket sections adapted to be nested, each section including at least three jacket legs. The base and lower jacket sections include cylindrical legs interconnected by box section bracing, the upper jacket sections including cylindrical bracing. The box section bracing is connected to the legs by a unique joint for transmitting stresses to the legs. The box section bracing is floodable for equilizing hydrostatic pressure during and upon installations. Certain transverse box section bracing at ends of adjacent jacket sections include intermediate connection projections for welding during joining of adjacent jacket sections. The cylindrical legs include a plurality of water tight compartments of selected volume, each compartment having one or more check valves for admitting water into the compartments when external water pressure exceeds air pressurization of the compartments. A method of installing the jacket tower includes floating the tower, to the site, on two of the legs; rotating the tower about a longitudinal axis to submerge one leg while at least the other two are at water level and tilting the structure by flooding certain portions of the base and lower sections and continuing such tilting by automatically flooding the legs by preselected pressure conditions in the water tight compartments until the tower reaches a vertical position. Once vertical, the remaining compartments are flooded to settle the tower vertically on the sea floor.

23 Claims, 40 Drawing Figures

Fig. 4.
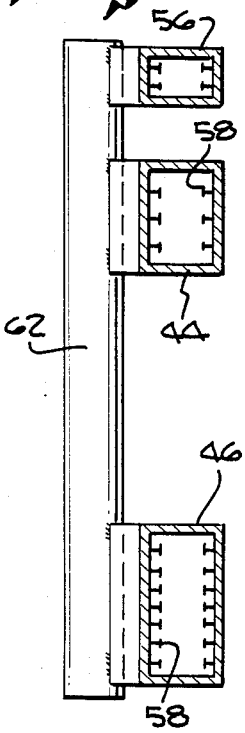
Fig. 6.
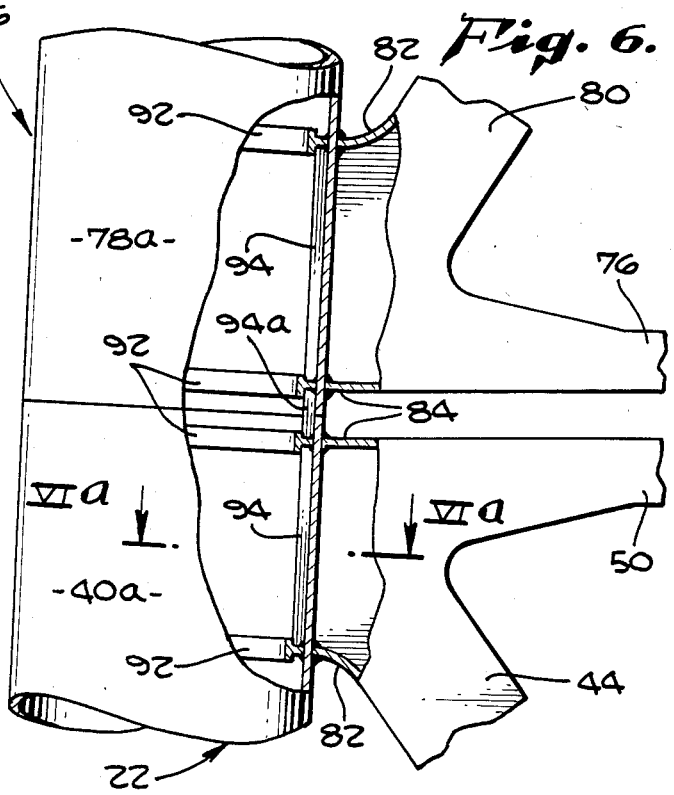
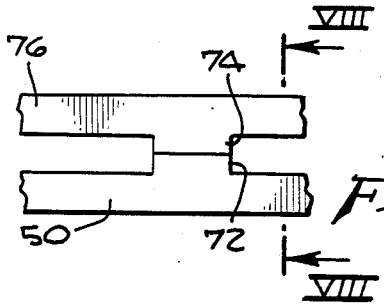
Fig. 7.
Fig. 6a
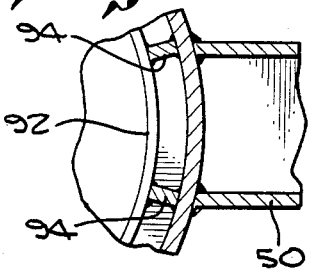
Fig. 5.
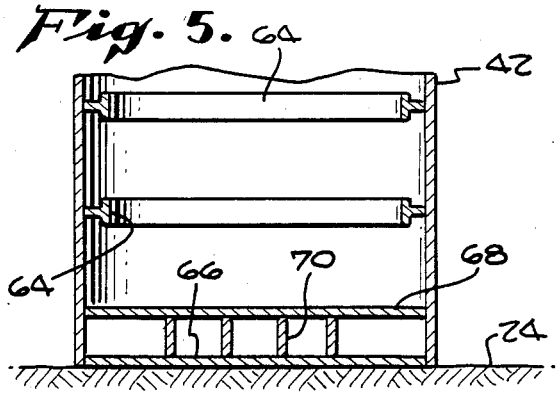
Fig. 8.
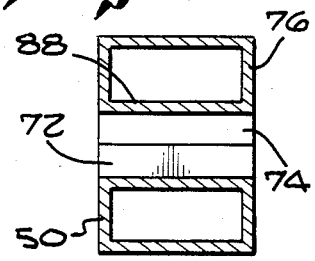

Fig. 27.
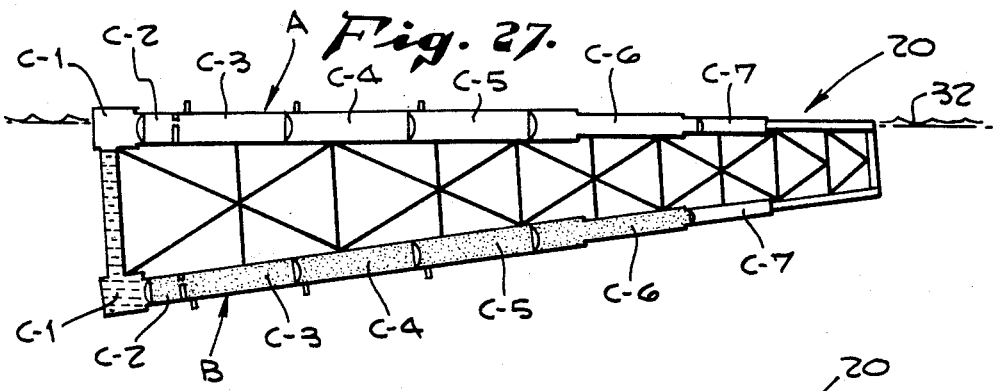
Fig. 29.
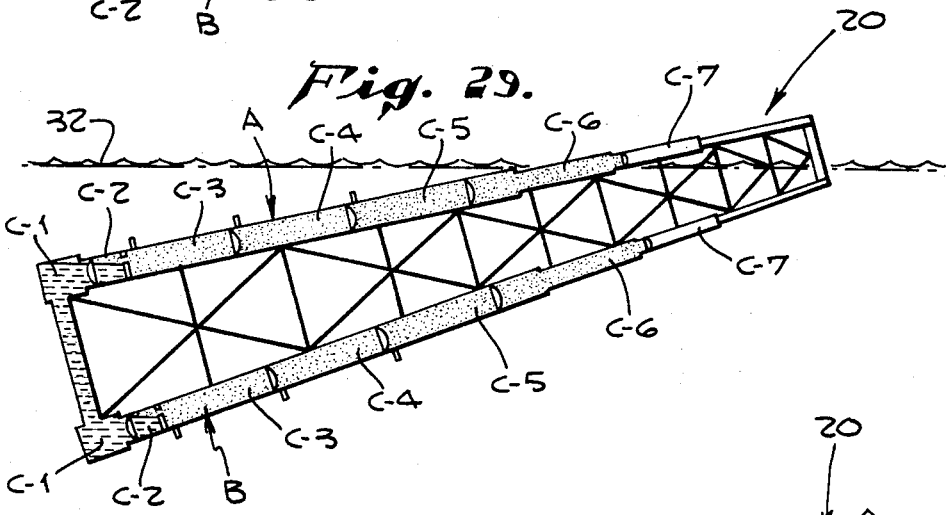
Fig. 28.
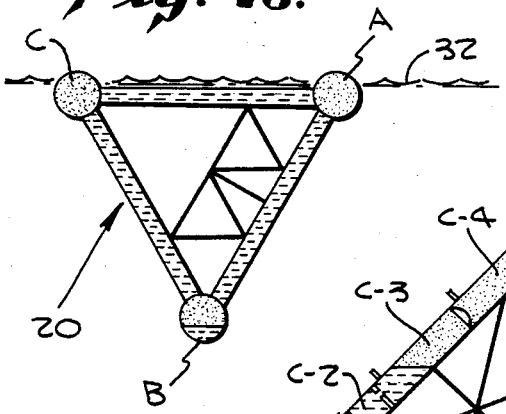
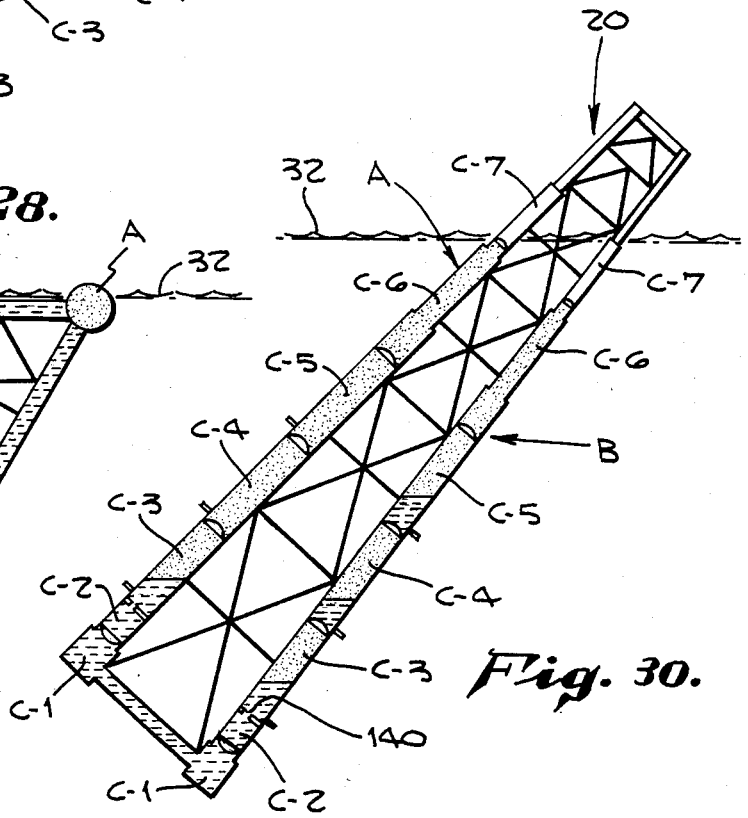
Fig. 30.

JACKET TOWER STRUCTURE AND METHOD OF INSTALLATION

BACKGROUND OF THE INVENTION

This invention relates to offshore jacket tower structures for use in deep water of 750 feet and more such as for example several thousand feet or more. Fixed jacket tower structures contemplate a tapering tower including three or more legs interconnected by various types of bracing utilizing structural steel sections and cylindrical members. Such tower structures have heretofore been constructed and used in relatively shallow water depths. Construction and use of prior proposed jacket tower structures for deep water becomes very expensive and the stresses involved in floating, transporting and erecting such prior proposed deep water towers require extensive use of truss type bracing because of the great weight of such a steel structure and also because of the forces imparted to the structure during transport and floating by wave and weather conditions.

Prior proposed jacket tower structures have included towers utilizing three legs such as shown in U.S. Pat. No. 2,586,966 in which three cylindrical legs are arranged in triangular section and interconnected by bracing of apparently structural steel sections. Other prior proposed tower structures include four jacket legs such as shown in U.S. Pat. No. Re. 28,614 in which the jacket tower comprises four legs and is supported for transport and flotation on a transport and launch apparatus comprising a pair of buoyant members extending the length of the tower and associated with two of the legs. The buoyant members are utilized in transferring the jacket tower from a horizontal floating position to a vertical upright position on the sea bed after which the buoyant members are separated from the tower.

A jacket tower assembled at sea by joining two or more jacket sections is shown in U.S. Pat. No. 3,859,806 in which jacket legs are provided with compartments provided with sea cocks, one acting as a flooding valve and the other as an air escape means, the sea cocks being operated by suitable power means. A crane on a barge is used to control the upper end thereof as the legs are flooded as the tower changes its position from a horizontal to a vertical position. This patent also shows means for joining two floating sections by pulling them together by winch means at least one leg being at the water surface and the other legs submerged.

U.S. Pat. No. 3,641,774 shows another method for assembling and completing fabrication of a multi-jacket section structure in which the jacket sections are guided into alignment, clamped together and then welded and in which a coffer dam device is utilized during the joining operation. Two parallel legs are at the water surface and a third parallel leg lies above the water surface.

U.S. Pat. No. 2,857,744 shows a support structure having three parallel legs interconnected by bracing adapted to be flooded during tilting of the structure to a vertical position from a horizontal position in which two legs are at the water surface and a third leg is above the surface.

While many of the prior proposed jacket tower structures which comprised a plurality of jacket sections were not designed for use in deep water the extension of such structures for use in deep water without modifying their design becomes extremely costly. The size and type of the jacket structural members and thickness of metal section required for use in deep water installations increases the costs of such structures so that they become prohibitive cost wise as well as imposing great difficulties in handling the several jacket sections of such large and long dimension.

SUMMARY OF THE INVENTION

The present invention relates to a novel jacket tower structure and method of installation adapted for use in deep waters such as 750 feet to 1600 feet or more and in which the structure is less expensive than presently known designs of jacket section structures and in which handling and installation of the several jacket sections forming the final jacket tower structure is facilitated. The invention contemplates the use of large rolled plate legs and bracing members which can be readily fabricated utilizing modular block construction methods. The invention additionally contemplates a novel joint structure for joining bracing members to cylindrical leg members whereby stresses involved in the structure are effectively transmitted to the legs. The invention additionally contemplates a step-tapered leg system which has a large diameter at the base and successfully reduces in conical transition steps to a smaller diameter at the water surface. The diameter of each section of the leg is proportioned such that the wave forces at the top of the structure are reduced to acceptable limits, buoyancy is sufficient to allow loading and off-loading on and off commercially available heavy lift submersible carriers, interconnection of jacket sections may be carried out in shallow sheltered waters, and axial alignment of leg elements for joining jacket sections together is facilitated while controlling the position of the jacket sections in the water. Particularly the invention contemplates a box section girder brace connection to a cylindrical leg for reducing stresses. The invention further contemplates box girder brace members for reducing fabricating costs and increasing flotation displacement during loading and off-loading, joining of legs of adjacent jacket sections, towing, and facilitating axial alignment during a joining operation.

The present invention contemplates a jacket tower structure comprising a plurality of jacket sections each having a suitable taper from a wide base portion to a narrower top portion in order to to increase the overall efficiency of the structure by reducing wave, current and wind forces at the top of the tower and increasing overturning resistance at the base thereof. Each jacket section comprises at least three cylindrical legs interconnected by bracing members some of which below 300 feet may be of box cross section in those jacket sections which are to be deployed in deep water and wherein the internal pressure in the box section bracing is placed in a condition of equalization with the hydrostatic external water pressure by suitable flooding of the box section girders. The box section bracing members at ends of a jacket section are provided with one or more intermediately located projecting securement portions adapted to facilitate interconnecting adjacent jacket sections during assembly. The ends of cylindrical legs of adjacent jacket sections are adapted to be secured together as by welding through use of coffer dams. The jacket tower structure also contemplates a novel joint structure for transmitting stresses from the box section bracing interconnecting jacket legs to the jacket leg by means of internal reinforcing means arranged with respect to the walls of the box section girder for effectively transmitting stresses. The jacket structure also contemplates the provision of water tight compartments in each of the legs thereof, such water tight compartments being provided with one or more water inlet pressure responsive check valves and with means for pressurizing the compartments with gas whereby the check valves will be actuated to a flooding open position by the external hydrostatic pressure of the water at the depth through which the compartment is passing during the installation.

The invention also contemplates a novel method of installation of such a jacket tower wherein the tower is readily transported by one of several methods to an assembly site such as by nesting the jacket sections and transporting them upon a vessel in nested relation, or by floating the jacket sections on two legs with one leg above water to a sheltered shallow water site and then assembling the jacket sections at the said site by joining the jacket sections together by suitable means. After assembly, the jacket can then be towed to the well site with two legs on the water and one leg above the water. The invention contemplates a preferred use of a three legged tower or tripod tower because this configuration provides a low center of gravity to provide for transporting the tower on vessels and for floating the tower with one leg out of the water and with a minimum draft. Once at the deep water well site the tower structure may be rolled through 60 degrees from a floating position with two legs at the water surface and a third leg thereabove into a position with two legs at the water surface and one leg below the water surface. Upon completion of the rolling step the tripod tower is ready for movement to a vertical position which is accomplished in a novel way by introducing sea water into certain compartments to initiate tilting of the tower and then, having previously pressurized certain compartments of each of the legs to a selected air pressure, the pressure responsive check valves to the compartments are automatically opened as the tower changes position to a different level in the sea and automatically moves to a vertical position after which air may be vented from the compartments, the compartments filled with water, and the jacket tower settled to the sea floor. The jacket tower is provided with pile sleeves to facilitate anchoring the tower to the sea floor by pile members driven and set into the sea floor.

It is therefore a primary object of the present invention to provide a jacket tower structure for deep water use which embodies a novel structural design and which facilitates installation of the tower at sea, which provides a means for adjusting trim of a jacket section prior to joining by flooding selected compartments in the bracing other than compartments in the legs to avoid excessive compartmentation in the legs, which achieves alignment during joining of the legs and jacket sections by a preferred guidance method utilizing the bracing rather than the legs to avoid interference with a coffer dam which may be installed around the leg connection during joining, and which provides a structure in which the wave, wind and current loads are reduced, overturning resistance is increased by step tapering the diameter of the legs to be smaller at the top and larger at the base and tapering the axes of the legs to be more closely spaced at the top relative to the base.

An object of the present invention is to provide a jacket tower and jacket tower sections which can be loaded and off-loaded on commercially available submersible carriers, the jacket tower and jacket sections being floatable on the surface with a shallow enough draft to make loading and off loading on such submersible carriers possible. A three legged jacket tower configuration in floating condition provides two legs and one side of the bracing for providing buoyancy while the other leg and two bracing sides are above water.

Another object of the present invention is to provide a jacket tower which can be assembled above water in shallow sheltered water areas such as are prevalent along the coast of the Gulf of Mexico.

A specific object of the present invention is to provide a jacket tower structure of new structural design in which cost is reduced by the employment of box girder connection and bracing for interconnecting legs of jacket tower sections to be located in deep water.

Another specific object of the invention is to provide a jacket tower structure in which box section bracing is employed and in which the joint structure for connecting the end of a box section girder to a cylindrical member is of novel design and effectively transmits stresses.

Another important object of the invention is to provide a jacket tower structure in which each of the legs is provided with a plurality of water tight compartments of selected volume, maintained under selected air pressure dependent upon the depth reached by the compartment during installation, and provided with pressure responsive check valves for automatically flooding said compartments when such water depth is reached to facilitate installation of the jacket tower structure.

A still further object of the invention is to provide a method of installing a floatable jacket tower structure at a sub sea site in which the tower structure is floated to the site on two legs with one leg above the water surface, rolling or turning said tower about the axis of one of the legs at the water surface through 60 degrees to submerge the other leg at the water surface and tilting the tower in its other leg submerged condition by selective flooding of leg compartments and bracing such flooding being substantially automatically determined by the depth in water of the compartment being flooded by the use of gas pressurized compartments and water admitting inlet check valves for such compartments.

A still further object of the invention is to provide a novel jacket tower structure comprising a plurality of jacket sections in which the interconnection of adjacent jacket ends is facilitated by winch means provided on the box girder bracing at each end of a jacket tower section and connected to spaced anchor means on the sea floor.

Still another object of the present invention is to provide a novel jack tower structure in which a plurality of jacket sections are so shaped and configured as to facilitate nesting thereof for transport in assembly on a suitable vessel to a well site.

The invention further contemplates a novel jacket tripod structure in which the base of the structure is pinned to the sea floor by a novel arrangement of pile guide member conductors.

Many other advantages of the present invention will be readily apparent from the following description of the drawings in which an exemplary embodiment of the invention is shown.

IN THE DRAWINGS

FIG. 4 is a fragmentary enlarged sectional view taken in the vertical plane indicated by line IV—IV of FIG. 3.

FIG. 5 is a fragmentary enlarged sectional view taken in the vertical plane indicated by line V—V of FIG. 2.

FIG. 6 is an enlarged fragmentary side elevational view partly in section of a joint construction at the area of joining two jacket sections together as indicated by the phantom line circle in FIG. 1.

FIG. 6*a* is a transverse section taken in the plane indicated by line VIa—VIa of FIG. 6.

Figure 1:
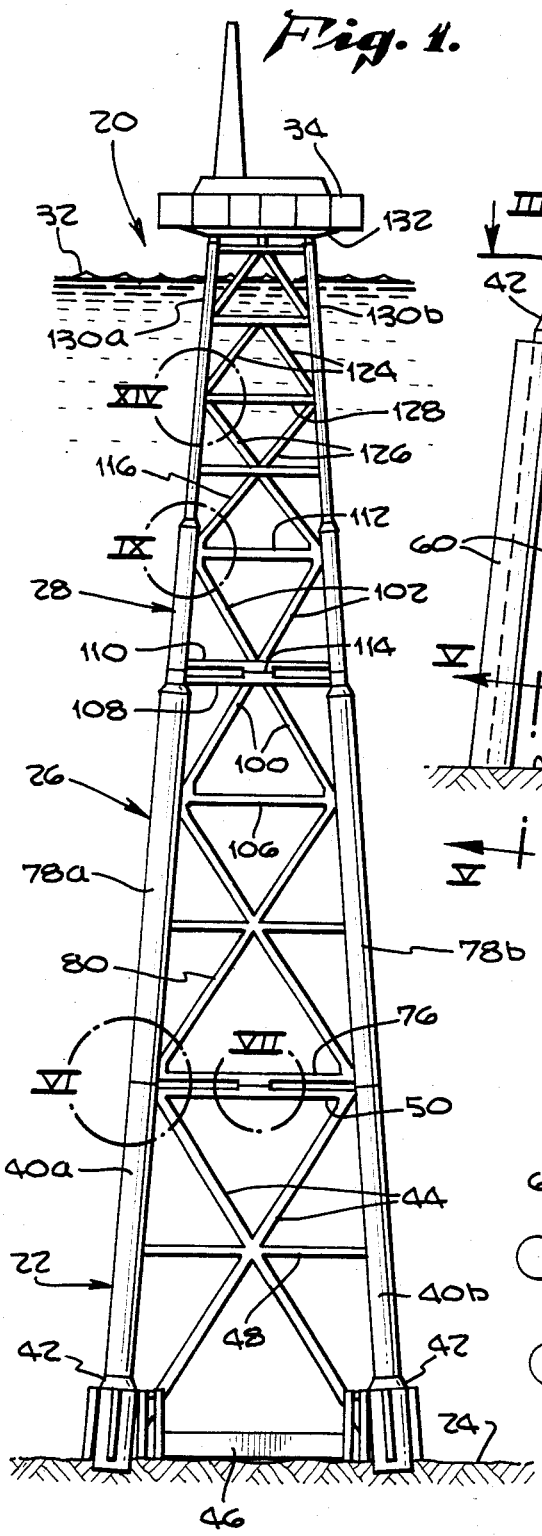
FIG. 1 is a side elevational view of a jacket tower structure embodying this invention installed on the sea floor and with a platform deck above the water surface.
Figure 2:
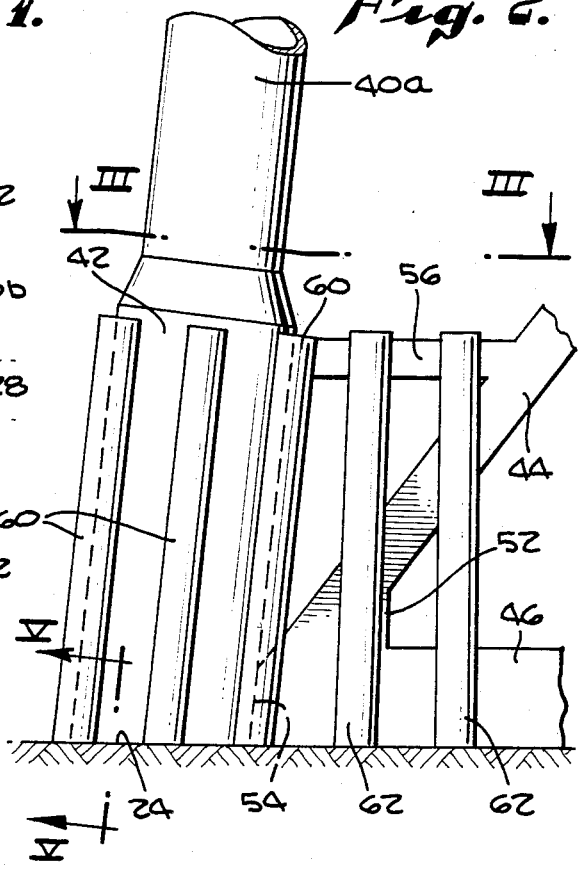
FIG. 2 is an enlarged fragmentary elevational view of a pile guide construction at the bottom end of one of the legs of the jacket tower for anchoring the tower to the sea bed.

FIG. 7 is an enlarged fragmentary view of a central connection between adjacent transverse box girders of adjacent jacket sections also indicated by a phantom line circle in FIG. 1.

FIG. 8 is a fragmentary sectional view taken in the plane indicated by line VIII—VIII of FIG. 7.

Figure 9:
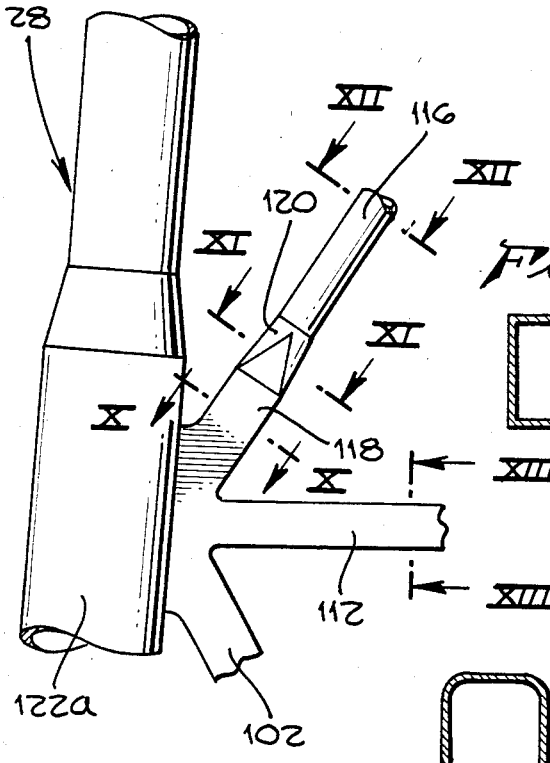

FIG. 9 is an enlarged fragmentary view of a joint construction indicated by the circular phantom line IX—IX of FIG. 1.

Figure 10:
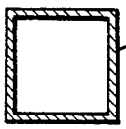

FIG. 10 is an enlarged sectional view taken in the plane indicated by line X—X of FIG. 9.

Figure 11:
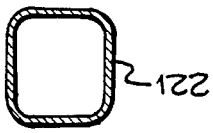

FIG. 11 is an enlarged sectional view taken in the plane indicated by line XI—XI of FIG. 9.

Figure 12:
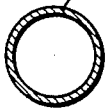

FIG. 12 is a sectional view taken in the plane indicated by line XII—XII of FIG. 9.

Figure 13:
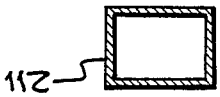

FIG. 13 is an enlarged transverse sectional view taken in the plane indicated by line XIII—XIII of FIG. 9.

Figure 14:
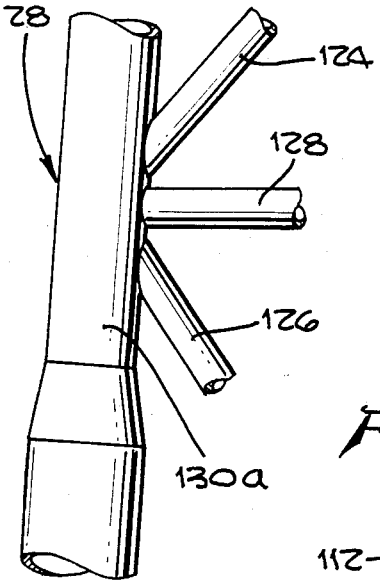

FIG. 14 is an enlarged fragmentary view of a joint construction in the tower indicated by the phantom circular line XIV—XIV of FIG. 1.

Figure 15:
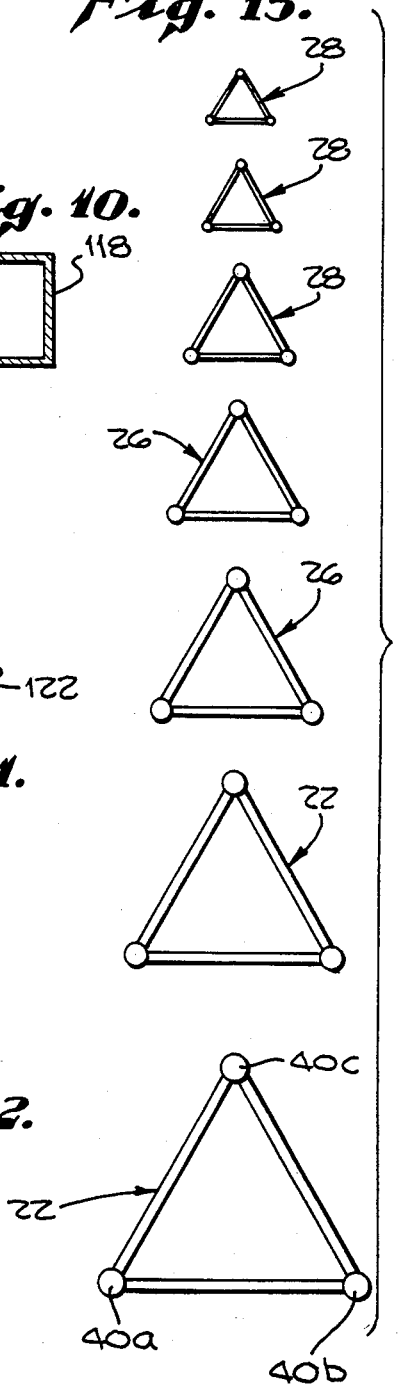

FIG. 15 is a schematic view illustrating the progressive decrease in triangular cross section of the tower from the base to the top of the tower and progressive step tapering of leg diameters of the tower from the base to the top thereof.

Figure 16:
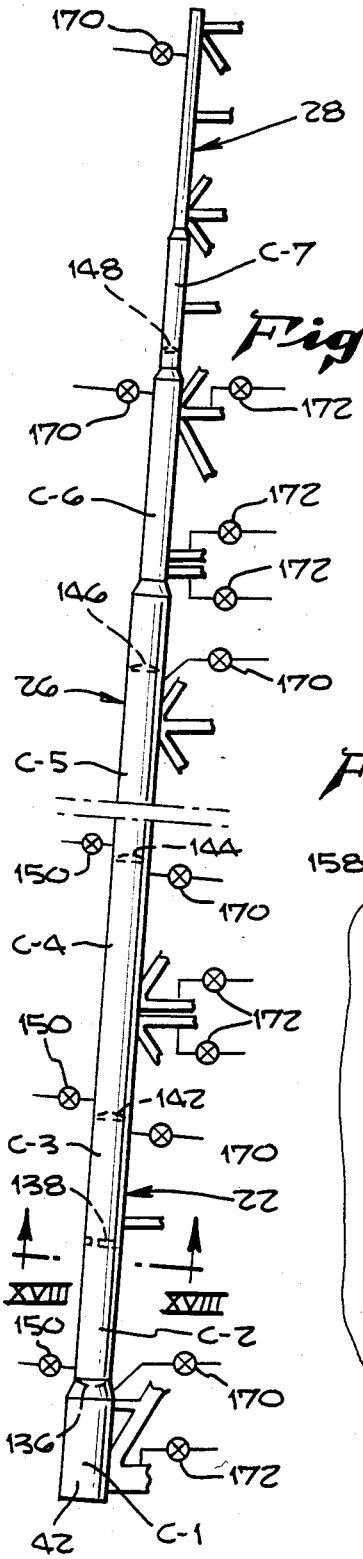

FIG. 16 is a fragmentary elevational view of one of the legs of the jacket tower shown in FIG. 1, the view illustrating the location of water tight compartments and schematic check valves.

Figure 17:
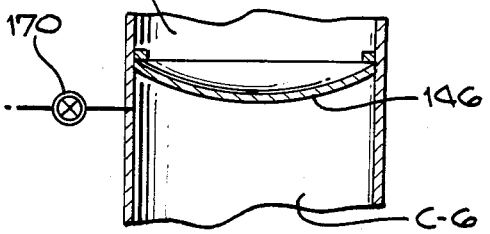

FIG. 17 is an enlarged fragmentary sectional view of one of the bulkheads in one of the compartments.

Figure 18:
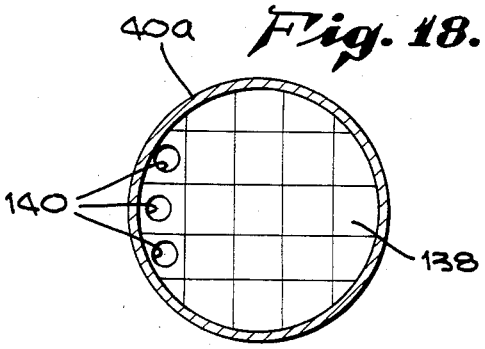

FIG. 18 is a transverse sectional view of one of the legs taken in the transverse plane indicated by line XVIII—XVIII of FIG. 16 and showing a bulkhead with limber holes.

Figure 19:
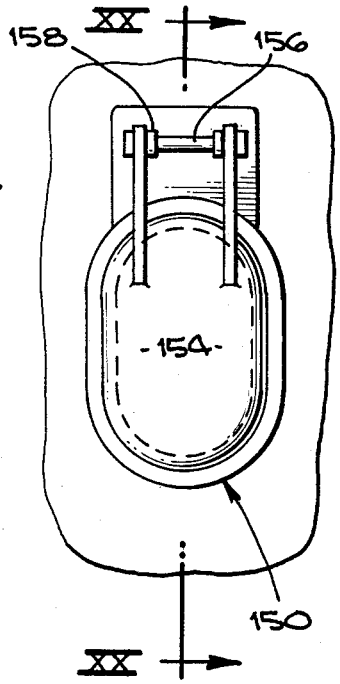

FIG. 19 is a fragmentary elevational view of a pressure responsive gate or valve for a compartment.

Figure 20:
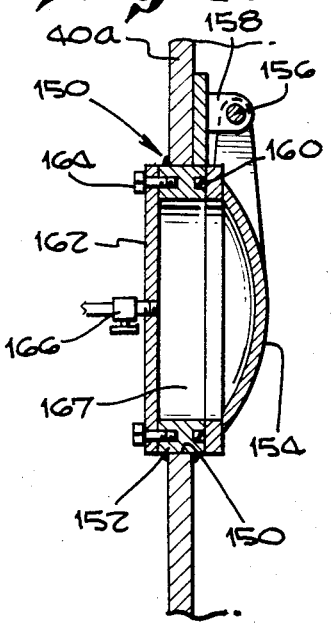

FIG. 20 is a sectional view of the gate shown in FIG. 19, the section being taken in the plane indicated by line XX—XX of FIG. 19.

Figure 21:
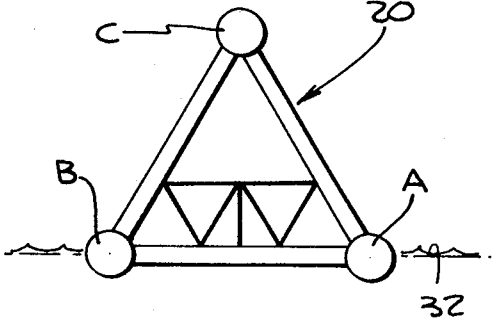

FIG. 21 is a schematic view showing a jacket tower structure of three leg design in floating position with two of the legs at Water surface and the third leg above the surface.

Figure 22:
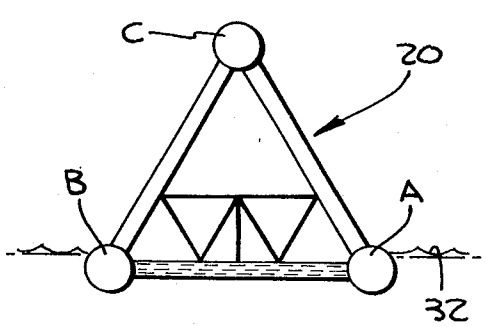

FIG. 22 is a schematic view showing the tripod jacket tower of FIG. 1 at the first step in turning the tripod tower by flooding the box girders between adjacent legs at the water surface.

Figure 23:
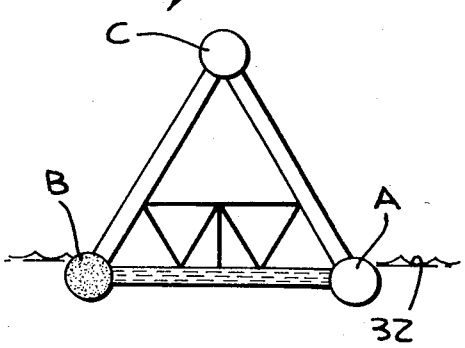

FIG. 23 is a further view showing the introduction and presence of air under pressure in one of the legs of the jacket to be submerged.

Figure 24:
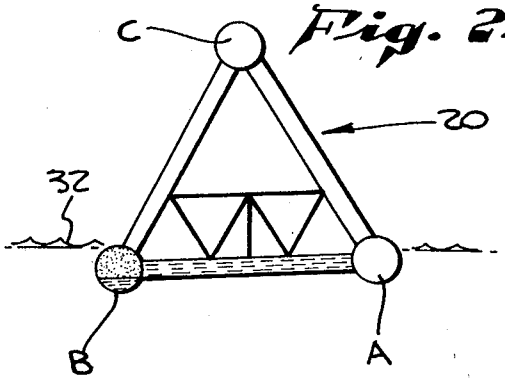

FIG. 24 illustrates partial flooding of the leg to be submerged to cause the jacket to turn counterclockwise as viewed in FIG. 24 about a longitudinal horizontal axis of an adjacent leg.

Figure 25:
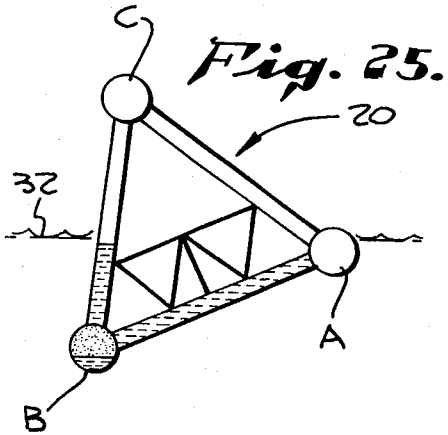

FIG. 25 shows a further step in the turning process wherein hollow bracing between adjacent legs is flooded to cause further turning of the jacket about the longitudinal horizontal axis.

Figure 26:
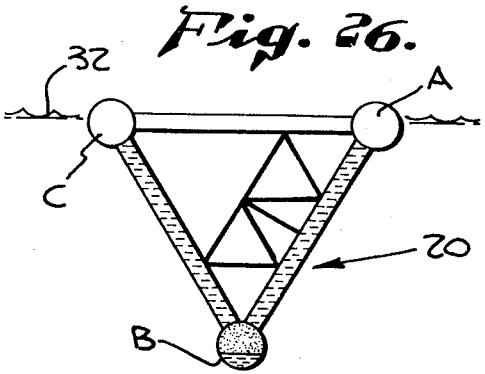

FIG. 26 is a view of the jacket tower with the turning operation completed showing the submerged leg partially filled with water and air, the flooded bracing between the submerged leg and the surface legs.

FIG. 27 is a side view of the jacket tower shown in FIG. 26.

FIG. 28 is an end view of the jacket structure shown in FIG. 27 and showing introduction of air under pressure into certain compartments in the legs at the water surface.

FIG. 29 is a side elevation of the jacket tower after water has been introduced into the lower portion of the legs and the box girder bracing at the bottom of the tower.

FIG. 30 is a further view of the tower being automatically ballasted toward a vertical position and illustrating the location of water introduced into the leg watertight compartments.

Figure 31:
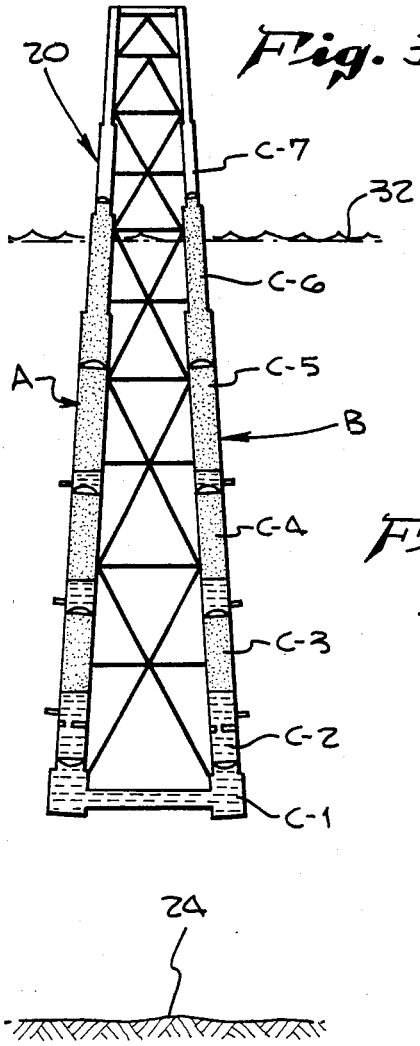

FIG. 31 is a further view in the step of moving the tower to vertical position and showing pressure air in the legs of the tower and the further introduction of water into the lower compartments of said legs.

Figure 32:
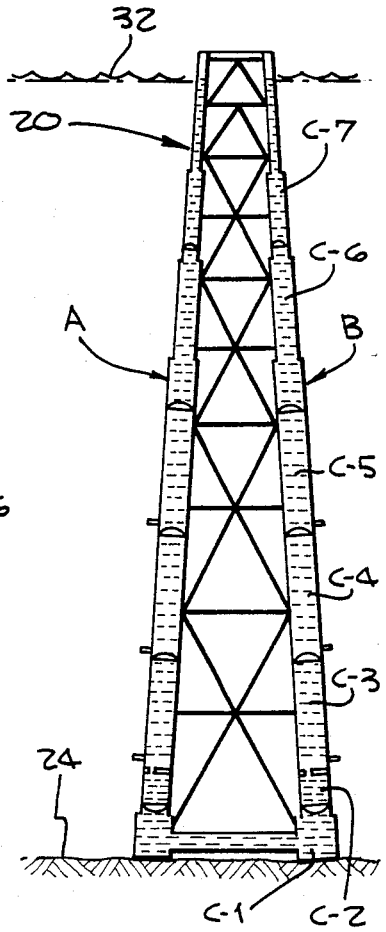

FIG. 32 is a view of the tower after the leg compartments have been entirely flooded, the air released therefrom, and the tower at rest on the sea floor and in vertical position.

Figure 33:
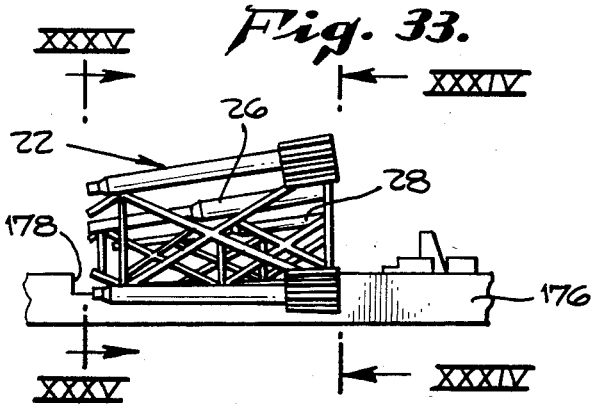

FIG. 33 is a fragmentary side elevational view of a vessel adapted to support and carry nested jacket sections to a assembly site.

Figure 34:
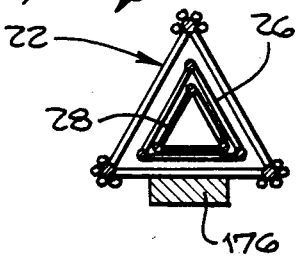

FIG. 34 is a schematic end view of the nested tower sections shown in FIG. 33 and at the plane indicated by line XXXIV—XXXIV.

Figure 35:
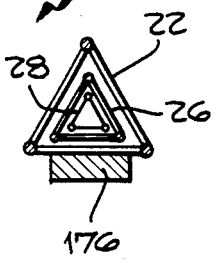

FIG. 35 is a similar end view taken from the plane indicated at line XXXV—XXXV of FIG. 33.

Figure 36:
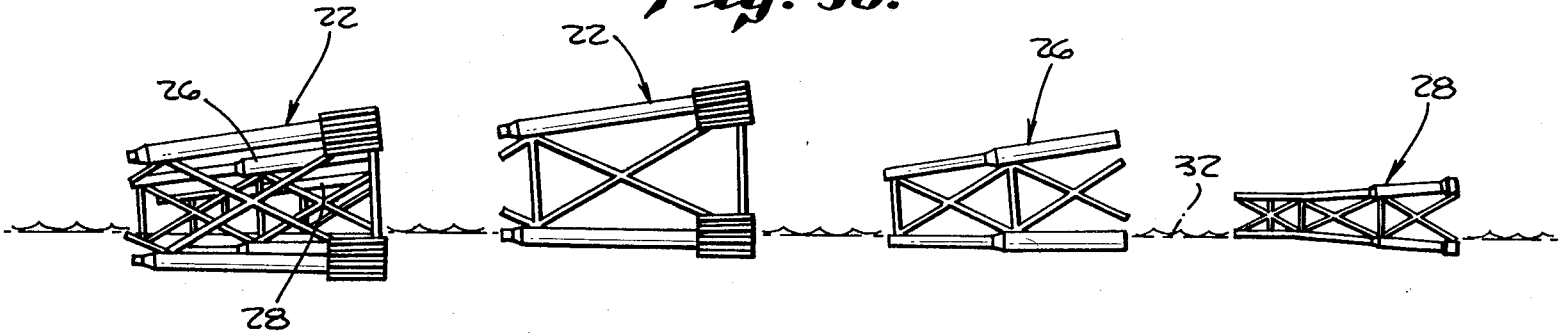

FIG. 36 is a view showing the nested assembly of jacket sections afloat at sea and certain of the sections being separated therefrom by floating out from the nested sections in disassembly thereof.

Figure 37:
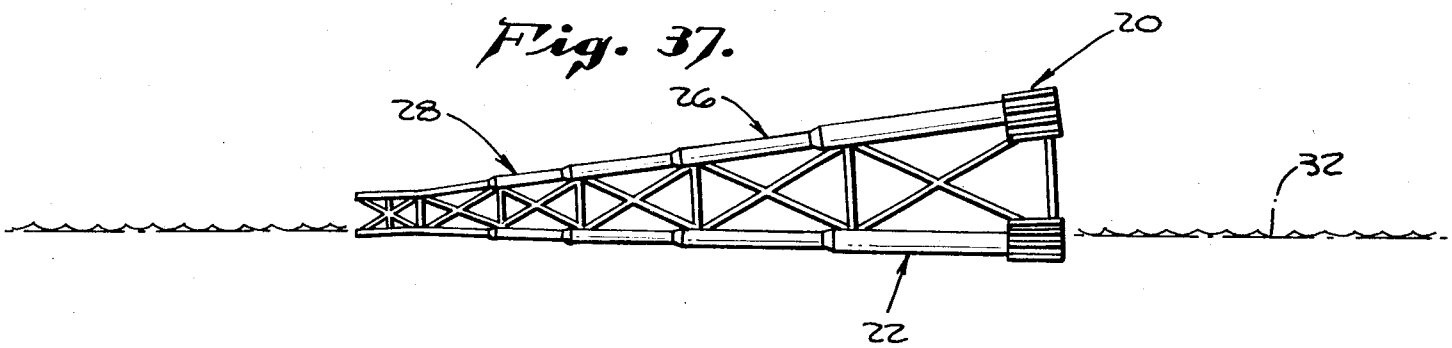

FIG. 37 is an elevational view of the jacket sections in assembled relation and floating on the sea surface with two of the legs at the water surface and one leg thereabove.

Figure 38:
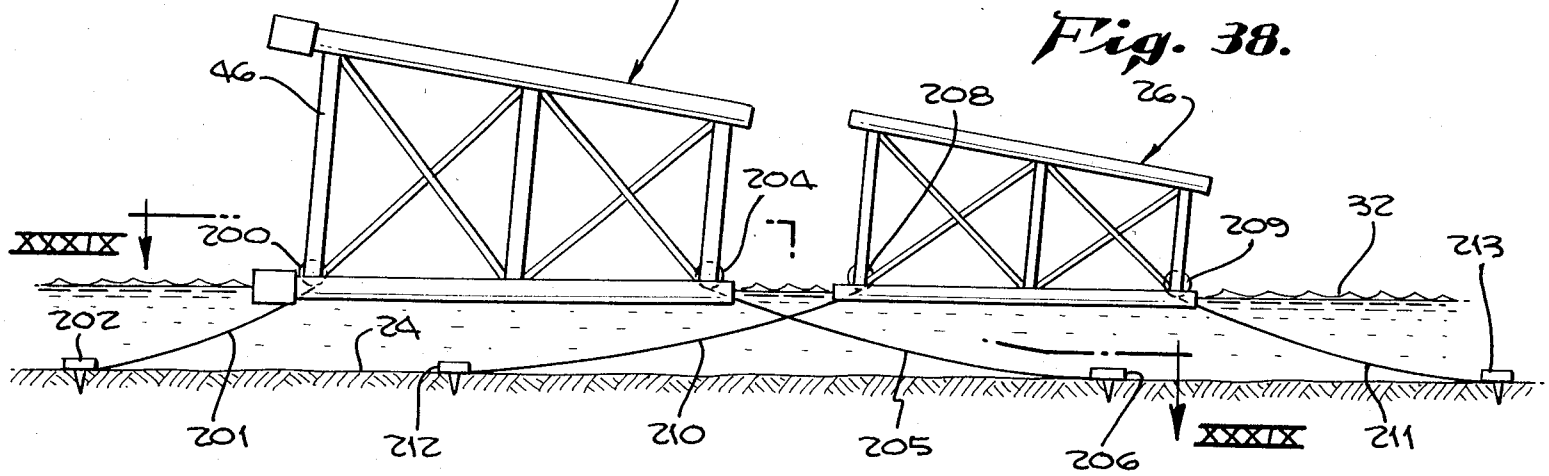

FIG. 38 is a schematic view illustrating relative positions of two jacket sections in shallow water with winch means connected to sea floor anchor means to facilitate holding the jacket sections in position in such shallow water and for drawing the jacket sections into alignment for interconnection.

Figure 39:
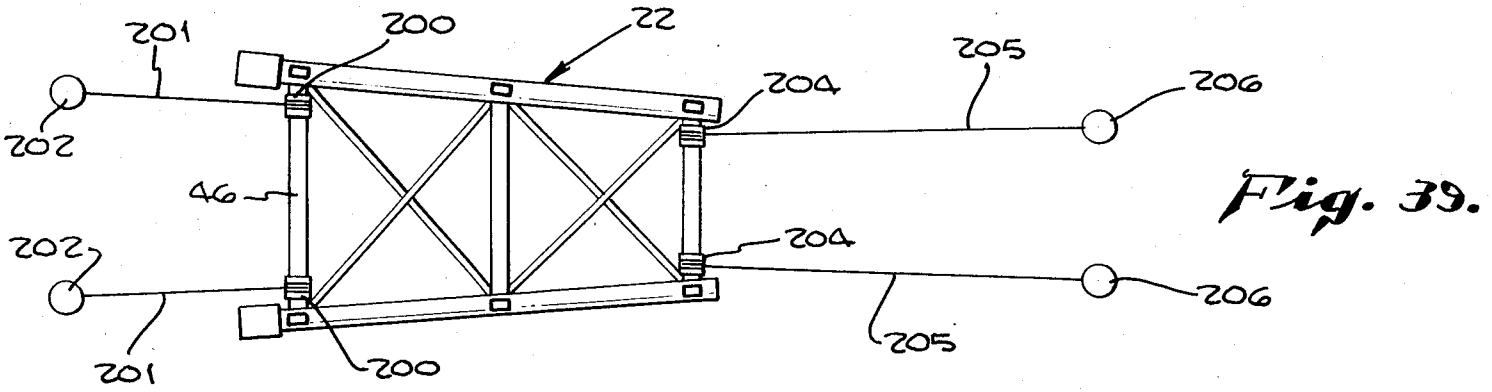

FIG. 39 is a top view of one of the jacket sections and the winch and anchor arrangement.

DETAILED DESCRIPTION

In FIG. 1 an offshore jacket tower construction embodying this invention is generally indicated at 20. The tower construction contemplated by this invention is designed for use in water depths of 750 feet to 1600 thousand feet or more. A preferred construction of the tower utilizes three legs, that is, a tripod tower construction. However it will be readily apparent that features of the present invention may be readily utilized in jacket tower constructions having more than three legs.

Generally speaking tower construction 20 comprises a plurality of interconnected tapering tripod jacket sections, with step tapered legs, a bottom jacket section 22 being seated and anchored as by piles on sea floor 24. Above bottom jacket section 22 may be provided an intermediate jacket section 26, and a top jacket section 28 which extends above the water surface 32 to support a platform deck 34. Platform deck 34 may be provided with the usual drilling, processing, and production facilities as required by the well site. Each of jacket sections 22, 26, and 28 may be separately fabricated and may be transported, floated, and assembled as later described.

Bottom jacket section 22 comprises three cylindrical jacket legs 40*a*, 40*b* and 40*c*. Each of legs 40*a*, 40*b*, and 40*c* includes a bottom enlarged cylinder portion 42. Adjacent legs define a planar side zone in which the legs are interconnected by hollow floodable bracing including diagonal girders 44 interconnecting opposite ends of adjacent legs. A bottom transverse girder 46, an intermediate transverse girder 48 and a top transverse girder 50 further interconnect adjacent legs in the planar side zone. Each of the girders 44, 46, 48 and 50 are of rectangular or box cross section, ends of box section girders 48 being welded to the cylindrical legs in usual manner.

Means are provided at the bottom end of each jacket leg 40*a, b, c* for attaching anchor piles (not shown) to pin the bottom of each leg to the sea bottom. As best shown in FIGS. 2, 3, 4 and 5 box section diagonal girder 44 is joined with box section girder 46 at 52 and the adjacent ends of both girders 44 and 46 are joined to the wall of the bottom cylindrical portion 42 at 54. A box section member 56 may span the space between the upper end of the enlarged cylindrical bottom portion 42 of leg 40 and diagonal girder 44. As shown in FIG. 4 each of the box section girders 44, 46 and 56 are provided with a plurality of spaced longitudinally extending T-reinforcing ribs 58.

Figure 3:
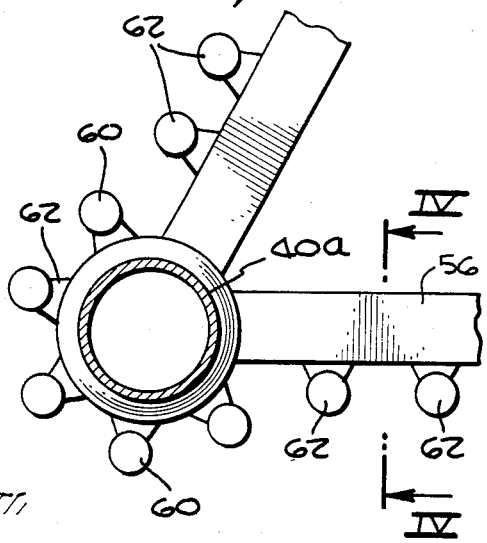
FIG. 3 is a fragmentary sectional view taken in the horizontal plane indicated by line III—III of FIG. 2.

Pile conductors 60 are secured to the bottom portion 42 of leg 40 by suitable plates 62*a*. Each of the pile conductors 60 are secured with their longitudinal axes parallel to the axis of leg 40 and have the same batter or angle with respect to the seabed. Spaced from the pile conductors 60 are at least a pair of pile conductors 62 in each side zone having their longitudinal axes disposed vertically and secured by welding to box girders 56, 44 and 46. As shown in FIG. 3 the vertically disposed pile conductors 62 lie in the planar zone of each of the contiguous side zones of the jacket section. This spaced arrangement of pile conductors having batter and vertically disposition provides extended anchoring engagement with the sea floor.

The bottom end portion 42 of each jacket leg 40 may also include internal circular reenforcing T-ribs 64 in suitable vertically spaced relation. The lowermost end section of each column 40 may be provided with spaced transverse bulkheads 66 and 68 with internal reenforcing vertical plates 70 to provide a closed load bearing end structure for each cylindrical leg for surface contact with the sea floor.

As shown in FIGS. 6 and 7 the connection between the bottom jacket section 22 and the intermediate jacket section 26 includes a novel arrangement of joining adjacent ends of said jacket sections for transfer of structural stresses. For this purpose the top transverse box section girder 50 of jacket section 22 is provided with a central upwardly extending boss or projection 72 adapted to be secured or welded to a corresponding downwardly extending boss or projection portion 74 provided on transverse box girder 76 interconnecting the bottom ends of jacket legs 78*a* and 78*b* of intermediate jacket section 26.

The joining of box section girders 50 and 76 with the upper end of jacket leg 40*a* and the lower end of intermediate jacket leg 78*a* respectively is shown in FIG. 6 and 6*a*. Diagonal box section leg 44 of section 22 joins with end transverse box section girder 50 adjacent the end of leg 40*a*. Similarly diagonal box section leg 80 joins with transverse end box section girder 76 adjacent the lower end of leg 78*a*. The top wall of girder 50 and the bottom wall of girder 76 are provided with gusset or fillet plates 84 which as they approach the wall of the cylindrical legs are inclined slightly upwardly so as to lie in a plane, adjacent to the surface of the cylindrical leg, which is normal to the axis of the legs 78*a*, 40*a*. The top wall of diagonal girder 80 and the bottom wall of diagonal girder 40 are provided with gusset or fillet plates 82 which as they approach the surface of the respective cylindrical legs 78*a* and 40*a* are disposed in a plane normal to the axis of the leg 78*a* and 40*a*. The gussets 82 and 84 are welded to the surface of the legs 78*a* and 40*a*.

Internally of each of the legs 40*a* and 78*a* at the ends thereof are provided T-section ring reinforcing ribs 92. One rib 92 is welded to the internal surface of leg 78*a* in the plane determined by the gusset plate 82. A second spaced rib 92 is also internally welded to the inner surface of leg 78*a* in the plane determined by the gusset plate 84. Internal ring reinforcing ribs 92 are similarly provided in such positions in the leg 40*a* at the planes determined by the gusset plates 84 and 82 connected with the girders 44 and 50.

Generally vertical sidewalls of the girders 80 and 76 for example, lie in planes parallel to the longitudinal axis of legs 78*a* and 40*a* and are welded to the cylindrical external surface of such legs where edges thereof abut with the cylindrical surface. Internally a longitudinally extending reinforcing rib 94 which lies in a radial plane having the axis of the leg as the center of the radius and has its outermost longitudinal edge welded to the internal surface of the cylindrical member at a location directly opposite the welding of the vertical walls of the girders 50 and 76 to the external surface of the leg. Such longitudinal reinforcing rib 94 extends between the adjacent two ring reinforcing ribs 92. When the abutting end edges of legs 78*a* and 40*a* are secured together as by welding a longitudinal reinforcing rib segment 94*a* is welded between the two adjacent ribs 92 at the joint between the two legs and such rib spans such joint in the plane defined by the sidewalls of the girders 50, 76, 44 and 80.

The joint construction between the top end of the intermediate section 26 and the bottom end of the top section 28 is similar to that above described and for purposes of brevity will not be further described except to note that diagonal girders 100 of the upper portion of the intermediate jacket section 26, diagonal girders 102 of the top jacket section 28 and the transverse girders 104, 106, 108, 110 and 112 are all of rectangular or box cross section. End transverse girders 108 and 110 are each provided with mating intermediate projections for welding at 114 as described above for the projections 72 and 74.

The joint structure of box girder 112 and diagonal girders 102, 116 with the cylindrical leg 28 may be generally similar to that described in FIG. 6 in that the top, bottom and side walls of the girders are provided with gusset plates for securement to the cylindrical wall of the jacket leg in planes transverse to and normal to the axis of the leg and may be similarly reinforced by internal circular T-section ribs. Internal longitudinally extending ribs in the planes of the side walls of the girders may also join spaced ring reinforcing ribs.

Each of the box section girders provided in the jacket sections 22, 26, and 28 are provided with the necessary fittings for flooding said girders with sea water and for introducing and relieving air under pressure in said girders for purposes later described. The introduction of water to flood the box section girders in the lower jacket sections which will be located at substantial depths in the sea serves the purpose of equalizing the internal and external pressures so that the box section girders can properly function as truss members of the tower and yet may be fabricated of a sectional metal thickness less than that required if the girder was required to withstand the hydrostatic pressures of the depth of installation.

In the top jacket section 28, FIG. 9, a joint structure between diagonal girders 102, upper diagonal members 116 and a transverse girder 112 is shown. FIGS. 9, 10, 11, 12 illustrate the conversion at the joint structure of the truss members from box section into cylindrical members. The top portion of the top jacket section 28, in this exemplary embodiment of the invention, is designated to be located at a depth in water where a cylindrical member may withstand hydrostatic external pressures without introduction of reinforcement means or internal pressure means to equalize such internal and external pressures. Further the diameter of the cylindrical member and the wall thicknesses thereof used at such water depths may be structurally satisfactory without special fabrication and increased cost thereof.

As shown in FIG. 9, diagonal girder 102 may be of box section as previously described for jacket sections 28, 26 and 22. The transverse girder 112 may also be of box section as indicated in FIG. 13. The diagonal girder 116 may be of cylindrical cross section as shown in FIG. 12. Cylindrical girder 116 merges into a box section cross section at 118, FIG. 10 through a transition girder portion 120, a converging portion 122 being shown in FIG. 11 which is part box section and part cylindrical section. At the joining of girder 116 with cylindrical leg **122*a* of the top jacket section through the box section girder portions provided by girders 102, 112 and 118, nonvertical walls thereof may be secured to the leg in a plane normal to and perpendicular to the axis of jacket leg 122*a*. The internal construction of this joint may be similar to that previously described and shown in FIG. 6**.

Top jacket section 28 and the joints (FIG. 14) for connecting diagonal members 124, 126, and a horizontal girder 128 to the stepped cylindrical leg **130*a* may include well-known types of welded joint structure for joining such cylindrical type girders such as 124, 126 and 128 to cylindrical top jacket section leg 130*a***.

The top ends of the top jacket section legs **130*a*, 130*b*, and 130*c* are connected to a suitable substructure at 132 of platform deck 34**. Such supporting connection for the platform deck may be of any suitable construction.

FIG. 15 is a schematic view illustrating the diminishing triangular cross sectional configuration of the jacket tower as it rises from the sea floor and from the bottom jacket section 22 to the top jacket section 28. This figure also illustrates together with FIG. 16 the step tapered leg system in which the diameter of each section of the leg is proportioned so that the wave forces at the top of the jacket tower are reduced to acceptable limits, buoyancy is sufficient to allow loading and off-loading on and off commercially available heavy lift submersible carriers for each of the jacket sections, either singly or in nested assembly.

In FIG. 16, one exemplary leg of the jacket tower is illustrated with only portions of the truss girders being shown at the leg, the purpose of the figure being to show the division of each jacket leg into water tight compartments. Bottom portion 42 of each jacket leg provides a watertight compartment C-1 being defined at its lower end by end closure bulkheads 66 and 68 (FIG. 5) and by a concave bulkhead partition or diaphragm 136 as viewed from the compartment C-2 located thereabove. The upper end of compartment C-2 is defined by a bulkhead 138 having one or more limber holes or ports 140 therein as better shown in FIG. 18. Compartment C-3 located above the bulkhead 138 is defined at its top by a bulkhead or diaphragm 142 of convex configuration as viewed from chamber C-4. Chamber C-5, chamber C-6, and chamber C-7 may be similarly defined by convex bulkhead diaphragms 144, 146, 147. In the present example of a jacket leg for a tower structure of about 1150 feet deep, compartments C-1, C-2, C-3 may have heights of approximately 100 feet each and compartments C-4, C-5, C-6 may have heights of approximately 200 feet each. The height of compartment C-7 may be approximately 200 feet although much of this compartment extends above water and/or is adjacent to water surface.

Each of the compartments may be provided with one or more pressure responsive check valves 150 (for example 6 to 8) located in the wall of the jacket leg. In FIG. 16 such check valves 150 are schematically illustrated as separated from the leg. An example of such a check valve 150 as shown in FIGS. 19 and 20. Each valve 150 may comprise a generally oval shaped frame member 152 welded in a corresponding oval shaped opening **150*a* provided in the wall of the jacket leg, in this example, 40*a*. A valve gate 154 is suitably hinged about a shaft 156 supported by brackets 158 carried internally of the jacket wall of jacket leg 40*a*. A suitable seal 160 may be provided in the circumference of the frame 152 for sealing engagement with the marginal edges of the gate 154. Externally of the jacket wall may be provided a cover plate 162 removably secured by suitable screw bolts 164 so that the cover plate may be removed prior to installation of the jacket tower at a well site. A test and bleed valve 166 is provided in the cover plate to maintain desired pressure within the chamber 167 at the check valve. As mentioned such check valves 150 of appropriate size and number may be provided for flow of sea water into chambers C-2, C-3, C-4, C-5**, under selected pressure conditions correlated to water depth.

Each of the compartments C-1 through C-7 may also be provided with a valve schematically indicated at 170, FIG. 16, for introduction and release of air into the compartments. Also each of the box girders both horizontal and diagonal in the jacket sections 22, 26, and 28 may be provided with valves schematically indicated at 172, FIG. 16, and operable by fluid pressure means, not shown, for flooding of said girders.

As hereinabove mentioned each of jacket sections 22, 26 and 28 may be separately fabricated and may be provided with suitable taper and dimensions to provide nesting of the three jacket sections as generally illustrated in FIGS. 33, 34 and 35. FIG. 33 shows the several jacket sections in nested relation, floated onto and carried on a suitable transport vessel 176 having a recessed central portion 178 adapted to carry the nested assembly of jacket sections for transport to a well site. The jacket sections may be onloaded and offloaded from such a vessel by introducing water ballast into vessel 176 to lower the vessel in the water until the jacket sections in assembly can be floated onto or off of the vessel. Vessels such as 176 are known for this purpose.

When the nested assembly of jacket sections has been floated off vessel 176, as shown in FIG. 36 the several jacket sections may be floatably separated by adjusting ballast in the bracing of each jacket section and moving one section relative to the other by pulling means such as tugboats. After separation the floating sections may be floated into position for assembly as shown in FIG. 37. In assembly of one jacket section with another jacket section it will be understood that the upper ends of, for example, jacket legs 40*a*, 40*b*, and 40*c* may be provided with longitudinally extending guide members (not shown) adapted to slidably engage guide receptors (not shown) on the adjacent ends of the jacket legs 78*a*, 78*b*, and 78*c*. During such assembly the two jacket sections may have temporarily mounted thereon winch means for drawing the two sections together in alignment and for guiding interengagement of the guide elements and guide receptors.

In FIGS. 38 and 39 an exemplary method of assembling adjacent jacket sections under shallow water conditions is shown. Such shallow water conditions are similar to those existing in the Gulf of Mexico area and contemplate the necessity for controlling motion of the jacket sections under conditions where adjacent vessels, structures or piers may be present. As shown in FIG. 38, jacket section 22 carries a pair of winch means 200 on an end transverse bracing member such as 46, the winch lines 201 extending to anchor means 202 longitudinally outwardly spaced from the base end of jacket section 22. At the other end of jacket section 22 transverse member 50 may carry a pair of spaced winch means 204 having winch lines 205 extending to anchor means 206 longitudinally spaced a distance away from the smaller end of jacket section 22. It will be apparent that the jacket section 22 is controlled in its position both longitudinally and laterally by the winch means 200 and 204.

Jacket section 26 is similarly tethered by winch means 208, 209 and associated winch lines 210 and 211 connected to longitudinally spaced anchor means 212 and 213. By adjusting the ballast in the bracing of both jacket sections so that their draft is equal and by suitable control of the winch means to draw the two jacket sections together by winch lines 205 and 210 while letting out on winch lines 201 and 211, the ends of the adjacent legs may be brought into alignment for interengagement of of the longitudinally extending guide members and guide receptors carried by the ends of the legs. When brought into aligned inter-engagement, the jacket sections 22 and 26 may be held in such position both longitudinally and to some extent laterally, by the winch means 200, 204, 208 and 209.

In the floating position of the jacket tower as shown in FIG. 37 the jacket tower has two of its legs floating at the water line also as shown in FIG. 21 as being legs A and B while jacket leg C is above the water. As one of the first steps in installation of the jacket tower at a well site it is desirable to roll the jacket tower about the axis of one of its legs in the water such as A to arrive at a position as shown in FIG. 26 for facilitating moving the tower from its horizontal position as shown in FIGS. 21–26 to a vertical position as shown in FIG. 31. The buoyancy of two of the legs of the jacket structure such as jacket legs A and B is adapted to float the tower together with the buoyant box girder construction along the side zone of the tower identified by the plane defined by legs A and B.

To commence turning of the tower through 60 degrees about the longitudinal axis of leg A for example, the box section girders in the side AB of the tower may be flooded as shown in FIG. 22 to submerge the side zone and box girders AB at or slightly below water level. As shown in FIG. 23 air under pressure may be introduced into leg B and leg B may then be partially flooded as shown in FIG. 24 to cause initial tilting of the jacket tower about leg A which is not flooded or pressurized. The tower is further turned by introducing water into the box section girders of side zone BC of the tower lying between legs B and C as shown in FIG. 25. As the box girders of side BC are flooded the tower further turns about leg A until upon full flooding of the girders of side BC, the tower assumes the position as shown in FIG. 26 with legs A and C located at the water surface and leg B fully submerged and part filled with water and air under pressure.

In further detail the compartments C-2, C-3, C-4 and C-5 of leg B may be pressurized with air or gas to approximately 125 psi and compartment C-6 pressurized to approximately 50 psi. When the compartment C-1 of leg B is partially flooded as shown in FIG. 24 such flooding seeks to change the longitudinal trim of the jacket tower in the water. To maintain desired trim of the jacket tower water may be added to the compartments of leg B.

FIGS. 27–32 illustrate the flooding of the box girders and jacket sections to tilt the jacket tower to a vertical position. While the drawing in FIG. 27 shows a single line for the truss box girders it will be understood that each of the lines represents a box girder as described in prior FIGS. 1–14 and are adapted to be flooded with sea water.

The condition of the jacket tower in the position shown in FIG. 27 may be illustrated in the chart below.

| | CONDITION | |
|---|---|---|
| Compartment | Leg B (submerged) | Legs A and C |
| C-1 | Flooded equalized | Empty |
| C-2 | Air 125 psig | Empty |
| C-3 | Air 125 psig | Empty |
| C-4 | Air 125 psig | Empty |
| C-5 | Air 50 psig | Empty |
| C-6 | Air atmospheric | Empty |
| C-7 | Air atmospheric | Empty |
| Bracing | Legs BC and BA | Legs AC |
| Cylindical members | Empty | Empty |
| Box girders | flooded equalized | Empty |

In further preparation for tilting the jacket tower the next step is to flood and equalize the box girder members in the side zone AC. The legs A and C are pressurized as indicated in the chart below:

| Compartment | Air pressure |
|---|---|
| C-1 | Empty at atmospheric pressure |
| C-2 | 125 psig |
| C-3 | 125 psig |
| C-4 | 125 psig |
| C-5 | 50 psig |
| C-6 | Empty atmospheric |
| C-7 | Empty atmospheric |

Completion of flooding the side AC and pressurizing the compartments in the legs A and C as above indicated is shown in FIG. 28. Under this condition the jacket tower will remain substantially horizontal with the lower end of legs A and C nearly submerged.

The next step in further tilting the jacket tower from its near horizontal position toward a vertical position includes pumping water into the compartments C-1 of each of the legs A and C until the tower begins to tilt (FIG. 29).

The bulkhead 136 separating the compartments C-1 and C-2 in each leg is so positioned in the leg such that submergence of the lower end of the jacket tower begins before the water reaches the level of the limber holes 140 in the bulk head 138. It should be noted that air pressure in compartments C-2 and C-3 will increase with the addition of water in the compartments and increasing water depth. Such rate of increase in air pressure is predetermined and is accounted for in the initial pressurization operation indicated above.

In the condition of the jacket tower during submersion and positioning the tower into an upright position, FIG. 30 indicates that each of the compartments C-2, C-3, C-4 and C-5 of each of legs A, B and C will equalize internal pressure therein with the external hydrostatic pressure when sea water enters through the check valves 150 located adjacent the bottom of the respective compartments. When the check valves on the legs reach a water depth such that the external hydrostatic pressure exceeds the internal air pressure, the check valves automatically open to permit entry of water at the preselected depth. In this respect it will be understood that while the drawings and the description refer to a single check valve at the bottom of a compartment it will be understood that additional check valves may be provided in each of the legs for opening under pre-selected pressure conditions. In FIG. 30 it will be noted that leg B, as a result of such further inclination of the tower, has admitted water in its compartments C-4 and C-5, that water has entered compartment C-3 through the limber holes 140, and water has commenced to enter compartment C-3 of legs A and C.

As the jacket tower legs are automatically flooded in their lower compartments as the tower moves from a horizontal position to a more inclined position and then finally to a vertical position as shown in FIG. 31, the system of air pressurization of the several compartments and the automatic pressure responsive action of the check valves which open when the exterior hydrostatic pressure exceeds the internal air pressure introduced into the compartments finally results in water completely flooding compartments C-1, C-2, and the lower part of compartment C-3 of each leg. The lower parts of compartments C-4 and C-5 are partially flooded while the remainder of the compartments C-3, C-4, C-5, C-6, C-7 are under selected air pressure which has, in compartments C-3, C-4, and C-5, increased from that given above in the initial condition of the jacket legs. In the upright condition of the jacket tower shown in FIG. 31 pressure in compartments C-1, C-2, C-3, C-4, C-5 in each leg have been equalized and are open to the sea, and the buoyancy of the jacket tower maintains the tower in the position shown in FIG. 31.

To lower the jacket tower to the sea floor in its vertical position water is pumped into compartment C-6 until the jacket tower is seated on the sea floor. The differential pressure in compartment C-6 is kept within selected limits by venting of the air therein.

When the jacket tower is seated on the sea floor as shown in FIG. 32 the air in each of the compartments is released or vented and water is introduced into all of the compartments of each leg, the water in compartment C-7 of each leg being approximately at the level of the sea surface.

After the jacket tower is resting on the sea floor in the condition as shown in FIG. 32 pile members may be driven and set in the pile sleeves provided at the bottom of each jacket leg as illustrated in FIGS. 1 and 3.

It should be noted that in the condition shown in FIG. 32 that the box girders of each of the legs have been flooded and that internal-external pressures on the girders and jacket legs are in a state of equilibrium.

It will be readily apparent to those skilled in the art that the jacket tower described above utilizing box girder sections for bracing provides a less expensive mode of construction, the joint structure for tying the box section girders into the cylindrical leg members transfers stresses to the leg members in a novel fashion and that the jacket tower, because of the equalization of internal and external pressures forces, in the structural members, is readily adapted for the construction of towers for use in deep water and is not limited to the example given above of a jacket tower of approximately 1150 feet high.

In the above description a method of floating nested jacket sections to a well site was described. It will be understood that various transport means may be employed for this purpose such as those shown in FIGS. 33 and 34 or the floating of individual jacket section to the well site by individual transport and then joining the several sections as briefly described above. It is also contemplated that catamarran type pontoons under two legs of a jacket section at the water surface may be used.

In the joining of the jacket sections in which the two sections are drawn together by winch lines and guided by means of guide members and guide member receptors to bring the jacket legs into alignment and proper registrations, it will be understood that after adjacent jacket sections have been brought into such properly aligned and registered position that the abutting ends of the legs may be welded together. Such welding of the legs may include the temporary construction of a coffer dam about the adjacent leg ends and welding the legs by suitable welding equipment and operators working in the coffer dam environment.

The important features and advantages of the above jacket tower structure include its structural configuration in which a combination of floodable box section girders are used for the truss structural members in the deep water sections, the joint structure for transmitting stresses from the girders to the jacket legs of different geometrical form, and the simplified virtually automatic method of changing the position of the jacket tower from a horizontal position on the surface of the water to a vertical position resting on the sea floor in which the jacket tower is first rolled about one leg to submerge one leg completely in the water and then pressurizing selectively under predetermined conditions certain compartment areas of the jacket tower and introducing water so that the jacket tower will automatically lower its bottom end and automatically seek a vertical position spaced above the sea floor where it may be lowered to the sea floor by additional flooding of certain upper compartments of the jacket tower.

Various changes and modifications may be made in the jacket tower construction and method of installation which may fall within the spirit of this invention and all such changes and modifications coming within the scope of the impended claims are embraced thereby.

I claim:

1. A method of installing a floatable jacket tower structure at a subsea site, said tower structure having a base means and a top means and including at least three cylindrical legs, hollow water tight bracing of selected volume at lower portions of said tower and water tight bracing of less volume at upper portions of said tower, said legs having a plurality of water tight compartments each provided with check valves to admit water at selected pressures, and means for selectively pressurizing certain of said compartments with air under pressure in relation to the depth to be reached by said compartments during installation; comprising the steps of:

transporting said jacket tower to a subsea site;

floating said tower on at least two legs with other portions out of the water;

rolling said tower structure 60 degrees about a longitudinal axis at one of said two legs to position at least one leg beneath the water surface and to leave at least two legs at the water surface;

pressurizing at least certain of said leg compartments in accordance with the hydrostatic pressure at a water depth to be reached by said certain compartments during upending;

flooding the bracing at the base means of the tower structure to commence submerging of the base means;

admitting water into the lowermost leg compartments of the lower portion of the jacket tower by water pressure overcoming preselected air pressure therein to automatically continue submerging of the base means until the jacket tower has reached a vertical position;

relieving said air pressure in certain of said lower leg compartments to permit admission of additional water into said leg compartments to cause further lowering of said jacket tower to the sea bed;

and filling additional leg compartments and said bracing with water to cause the jacket tower structure to settle and rest in stable vertical position on the sea floor.

2. In a method as claimed in claim 1 wherein the tower structure includes a plurality of tapering tower sections, and wherein the step of floating said tower structure to a subsea site includes the step of:

nesting the plurality of tower sections, one within the other and transporting the nested sections to an assembly site;

separating the nested sections one from the other;

and joining the separated nested sections into a unitary tower of tapering configuration.

3. A method as claimed in claim 1 wherein the tower structure includes a plurality of tapering tower sections and wherein the step of transporting a jacket tower to a subsea site includes the steps of:

nesting said jacket sections to provide an assembly of jacket sections;

floating said assembly of nested jacket sections onto a vessel;

transporting said assembled nested sections on said vessel to a tower assembly site;

partially submerging said vessel to permit floating of said assembly of nested sections free from said vessel;

and separating said nested sections and interconnecting the nested sections to provide a unitary tower structure.

4. In a method as claimed in claim 1 wherein the step of rolling said tower structure through 60 degrees includes the steps of:

flooding bracing along a side structural zone between the said two legs at the water surface to partially submerge the said two legs;

pressurizing with air one of said two legs at the water surface;

admitting water into the compartments in said one of said two legs to cause said tower to begin to turn about a longitudinal axis at the other of said two legs to commence submerging of said one leg;

admitting water into the bracing extending between the said submerging one of said two legs of the adjacent side zone and a leg above the water level;

and continuing to admit water into the floodable bracing between said submerging leg and leg above the water to cause said tower structure to roll through approximately 60 degrees about said longitudinal axis until at least two legs are at the water surface.

5. A method as claimed in claim 1 including the step of:

maintaining lengthwise trim of said tower structure by selectively admitting water to said water tight compartments of said one of said two legs being submerged.

6. A method as claimed in claim 1 wherein the step of trans-porting said jacket tower to a subsea site includes:

providing a vessel with a jacket tower receiving section;

onloading the jacket section in the tower receiving section by lowering the vessel in the water to a selected draft to permit floating the jacket section over the receiving section;

transporting the jacket section to a site at less draft;

and off-loading said jacket section by increasing the draft of the vessel and floating the jacket section off the vessel.

7. In a jacket tower structure comprising, in combination:

a plurality of tower sections, each tower section including at least three hollow cylindrical buoyant legs, adjacent pairs of legs forming a planar side structural zone;

means interconnecting said adjacent pair of legs in each side zone;

said interconnecting means for certain lower sections including water tight hollow box section bracing members, said bracing members being adapted to be selectively flooded during and upon installation of said tower structure;

said bracing members including a transverse end bracing member interconnecting adjacent ends of said jacket section legs of a lower jacket section;

said transverse end bracing members having a planar wall including one or more intermediate bosses extending toward and facing an adjacent tower section for securement to corresponding bosses on an opposed wall of the end box section member of such adjacent tower section.

8. A tower structure as claimed in claim 7 wherein said means interconnecting said adjacent pairs of legs include:

diagonal and transverse box section bracing members in said side zone interconnecting adjacent legs, certain walls of said transverse box section bracing members being jointed to a cylindrical wall of the cylindrical leg in a transverse plane normal to the axis of said cylindrical leg, said cylindrical leg being provided with internal circular reinforcing ribs opposite to said walls of the bracing members.

9. A tower structure as claimed in claim 8 wherein said circular reinforcing ribs at said joining of said walls of said transverse box section member with said cylindrical leg include:

internal longitudinal ribs interconnecting said circular reinforcing ribs and opposite planar bracing walls lying in planes parallel to the longitudinal axis of the leg.

10. In a jacket tower structure comprising, in combination:

a plurality of tower sections, each tower section including at least three hollow cylindrical buoyant legs, adjacent pairs of legs forming a planar side structural zone;

means interconnecting said adjacent pair of legs in each side zone;

said interconnecting means for certain lower sections including water tight hollow bracing members, said bracing members being adapted to be selectively flooded during and upon installation of said tower structure;

said bracing members including a transverse bracing member interconnecting adjacent ends of said jacket section legs of a lower jacket section;

said transverse end bracing members including one or more intermediate bosses extending toward an adjacent tower section for securement to corresponding bosses on the end section member of such adjacent tower section;

each of said cylindrical legs including a plurality of water tight compartments provided with one or more normally closed pressure responsive water inlet check valves;

each of said water tight compartments including means for connection to a source of air under pressure for pressurizing said compartment to permit selective opening of the pressure-responsive check valve at a selected water depth.

11. In a jacket tower construction comprising, in combination:

at least two jacket tower sections;

each jacket section including at least three legs, adjacent pairs of legs forming a planar side structural zone;

at least two of said jacket tower sections including transverse box section girders interconnecting adjacent ends of said legs of each of said section;

a jacket section connection means intermediate ends of each box section girder adapted to be secured to an opposed jacket section connection means of the adjacent jacket section box girder;

said cylindrical legs on said jacket sections when assembled into a jacket tower including water tight compartment means of different volume extending from the bottom of the tower structure to the top of the tower structure;

said tower structure including means for selectively pressurizing with gas each of said compartments in relation to the depth of water at which the compartment means is adapted to be submerged during installation;

and means including pressure responsive valves for said compartment means adapted to respond to such water depth of the compartment means as determined by the pressure of gas in said compartment means.

12. In an offshore tower construction adapted to rest on the sea floor and to support a platform deck above the water surface, the combination of:

a plurality of tapering jacket sections of diminishing tapering configuration from a base jacket section to an upper jacket section;

means for bracing said base jacket section and certain lower jacket sections including hollow girders provided with means for flooding said girders;

means for bracing said upper jacket sections and certain sections therebelow including cylindrical girders;

said jacket sections including cylindrical legs provided with bulk heads defining a plurality of water tight compartments;

means for introducing ballast into said leg compartments;

means for introducing air under pressure into said compartments and including vent means for air therein;

means for interconnecting said jacket sections in end to end relation;

means on said base jacket section for receiving anchor pile members in parallel relation to the longitudinal axis of each leg;

and means on said base jacket section adjacent each of said legs for receiving anchor pile members in vertical relation for expanding the anchoring area of said tower to a sea floor.

13. A method for positioning a tripod tower and floating the same to a sub sea well site; including the steps of:

floating said tower with three legs empty with a first leg and a second leg at the water surface and a third leg thereabove;

flooding bracing between said first and second legs to partially submerge the first and second legs;

introducing air under pressure into said first leg;

introducing water into the bracing between said first and second legs;

and flooding bracing between said first and third legs until the first leg is lowermost and the second and third legs are at the water surface whereby the tower is rolled through 60 degrees about a longitudinal axis at the second leg.

14. A method of positioning a tripod tower as claimed in claim 13 in which each of said legs of said tower include water tight compartments provided with water inlet check valve means and air pressure valve means including the additional steps of:

positioning said tower from substantially horizontal position with one leg submerged to vertical position including flooding the bracing between the second and third legs and pressurizing with air certain compartments of legs two and three;

flooding legs two and three and lower compartments of the lowermost jacket portion whereby the lower ends of legs two and three are slightly submerged and the tripod is almost horizontal;

flooding compartments adjacent to the lowermost compartment of legs one, two and three until upending of the tower commences;

flooding and equalizing adjacent upper compartments of legs one, two and three as sea water enters through inlet check valves at the bottom of respective compartments, such flooding occurring automatically when check valves reach a water depth such that the external hydrostatic pressure exceeds internal air pressure in said compartment;

equalizing the water in compartments of each leg to position the tripod in upright position;

flooding additional upper compartments until the tripod is lowered to the sea floor;

and venting air from all compartments of legs one, two and three and bracing after the tripod is resting on the sea floor to introduce water in said compartments to stabilize said jacket tower in position on the sea floor.

15. A method as claimed in claim 13 wherein said tripod tower includes at least two tower sections, each tower section having three tapering legs, including the steps of:

floating each tower section with legs empty with a first leg and a second leg at the water surface and a third leg thereabove;

and interconnecting tower sections in such floating position before rolling the tower through 60° about one of said legs.

16. A jacket section for an offshore jacket tower comprising, in combination:

at least three cylindrical jacket legs having water tight compartments and inwardly inclined towards each other from their base to the their top;

hollow transverse and diagonal cross bracing members interconnecting adjacent legs in the plane defined by said adjacent legs;

the bracing members at each end of the jacket section lying transversely to the longitudinal axis of the jacket section and connecting ends of said legs;

said bracing members being floodable to provide internal pressures equal to external hydrostatic pressures at the water depth of the submerged bracing;

and means on said bracing member including gusset plate portions lying transverse to the axis of said legs and including wall portions parallel to said longitudinal axis for connecting said cross bracing members to said legs.

17. A jacket section as claimed in claim 16 including internal longitudinal ribs within each cylindrical leg opposite said wall portions of said bracing members lying parallel to said longitudinal axis;

and internal ring reinforcing ribs opposite said gusset plate portions and interconnected by said longitudinal ribs.

18. In a jacket section for an offshore jacket tower having inclined cylindrical jacket legs interconnected by transverse and diagonal box section girders having walls lying in planes transverse and normal to the axis of said jacket tower and walls extending longitudinally of said jacket tower, the provision of:

a joint means for interconnecting each cylindrical leg with said box section girders comprising:

a planar wall of a transverse girder lying normal to the axis of said jacket tower;

a diagonal wall of said diagonal girder having a terminal wall portion terminating normal to the axis of said cylindrical leg;

said longitudinal walls of said diagonal and transverse girder being secured to said cylindrical leg along lines parallel to the axis of said leg;

and internal annular ribs within said cylindrical leg opposite the joining of said transverse girder walls and terminal wall portion of the diagonal girder with said cylindrical leg.

19. A jacket section as claimed in claim 18 including:

internal longitudinally extending ribs within said cylindrical leg and lying between and interconnecting said adjacent internal annular ribs opposite the joining of said longitudinal walls of said transverse and diagonal box section girders.

20. In a jacket tower construction comprising, in combination:

a jacket tower section including at least three legs;

said jacket section including floodable box section girders interconnecting said legs of said jacket section;

said legs on said jacket section including watertight compartments of different volume extending from the bottom of the jacket section to the top thereof, said jacket tower section including means for selectively pre-pressurizing with gas at least certain of said compartments in relation to a selected depth of water at which the compartments are to be submerged upon installation;

and valve means for each of said certain compartments actuatable at such selected water depth in accordance with the pressure of gas in said compartment.

21. In an offshore tower construction adapted to rest on the sea floor and to support a platform deck above the water surface, a combination of:

a plurality of tapering jacket sections of diminishing tapering configuration from a base jacket section to an upper jacket section;

means for bracing said base jacket section and certain lower jacket sections including hollow girders provided with means for flooding said girders;

means for bracing said upper jacket sections and certain sections therebelow including cylindrical girders;

said jacket sections including cylindrical legs provided with bulk heads defining a plurality of watertight compartments of different volume;

means for introducing and maintaining air under selected pressure in said compartments and including vent means for air therein;

means for selectively introducing ballast into said leg compartments in accordance with a predetermined depth of said compartment in water during and upon installation;

means for interconnecting said jacket sections in end-to-end relation while in horizontal floating position;

and means for controllably tilting the interconnected jacket sections to a vertical position;

said means for selectively introducing ballast into said leg compartments including valve means actuated in accordance with the selected air pressure in said compartments.

22. A method of positioning a tripod tower from horizontal position to vertical position in which hollow bracing interconnects adjacent legs of a tower having at least three legs, said legs of said tower including watertight compartments provided with water inlet valve means and air pressurizing means and in which said tower is adapted to have leg one submerged and legs two and three at the water surface; including the steps of:

flooding the bracing between the second and third legs and pressurizing with air certain compartments of legs two and three;

flooding lower compartments of legs two and three of the lowermost tower portion whereby the lower end of legs two and three are slightly submerged and the tripod tower is slightly off horizontal;

flooding compartments adjacent the lowermost compartment of each of said legs one, two and three until upending of the tower commences;

flooding and equalizing adjacent upper compartments of legs one, two and three as seawater enters through inlet valves at the bottom of respective compartments, such flooding occurring as said inlet valves reach a water depth such that the external hydrostatic pressure exceeds pre-pressurized internal air pressure in said compartment;

and equalizing the water in compartments of each leg to position the tripod in upright position.

23. The method as claimed in claim 22 including the step of:

venting air from all compartments of legs one, two and three and flooding said bracing and compartments to stabilize said jacket tower in position on the sea floor.

* * * * *